US005425972A

United States Patent [19]

Calvert

[11] Patent Number: 5,425,972

[45] Date of Patent: Jun. 20, 1995

[54] HEAT SEALED, OVENABLE FOOD CARTON LIDS

[75] Inventor: Barry G. Calvert, Covington, Va.

[73] Assignee: Westvaco Corporation, New York, N.Y.

[21] Appl. No.: 185,054

[22] Filed: Jan. 24, 1994

Related U.S. Application Data

[63] Continuation-in-part of Ser. No. 48,794, Apr. 16, 1993, abandoned.

[51] Int. Cl.[6] ..... B32B 27/10; B32B 27/14; B32B 27/30; B32B 29/04

[52] U.S. Cl. ..... 428/34.2; 428/36.6; 428/212; 428/219; 428/341; 428/349; 428/354; 428/355; 428/511; 428/513; 428/512; 428/537.5; 229/3.5 R

[58] Field of Search ..... 428/34.2, 35.7, 36.6, 428/507, 511, 36.7, 34.4, 34.5, 346, 347, 349, 354, 355, 512, 513, 525, 537.5, 212, 219, 340, 341, 342, 328; 427/208.2; 156/308.2, 309.6, 332; 229/901, 902, 903, 3.1, 3.5 R

[56] References Cited

U.S. PATENT DOCUMENTS

| | | | |
|---|---|---|---|
| 3,788,876 | 1/1974 | Baker et al. | 117/38 |
| 3,863,832 | 2/1975 | Gordon et al. | 229/30 |
| 4,002,801 | 1/1977 | Knechtges et al. | 428/474 |
| 4,070,398 | 1/1978 | Lu | 206/524.2 |
| 4,249,978 | 2/1981 | Baker | 156/291 |
| 4,336,166 | 6/1982 | Penczuk et al. | 524/53 |
| 4,438,232 | 3/1984 | Lee | 524/272 |
| 4,469,754 | 9/1984 | Hoh et al. | 428/476.3 |
| 4,522,972 | 6/1985 | Mondt et al. | 524/548 |
| 4,861,821 | 8/1989 | Aubry et al. | 524/512 |
| 4,930,639 | 6/1990 | Rigby | 206/621 |
| 5,039,339 | 8/1991 | Phan et al. | 428/481 |
| 5,169,470 | 12/1992 | Goldberg | 156/244.14 |
| 5,183,706 | 2/1993 | Bekele | 428/349 |
| 5,217,159 | 6/1993 | Calvert et al. | 229/3.1 |
| 5,234,159 | 8/1993 | Lorence et al. | 229/125.35 |

*Primary Examiner*—Paul J. Thibodeau
*Assistant Examiner*—Vivian Chen
*Attorney, Agent, or Firm*—J. R. McDaniel; R. L. Schmalz

[57] ABSTRACT

Lids and/or closures applied to cartons which are used for distributing, marketing and heating small portions of prepared food are fabricated with a paperboard structural substrate coated with a heat activated (or sealable) coating of water soluble acrylic emulsion that is applied by means of a press in conjunction with a printing operation or, alternatively, by a coating operation separate from the printing operation. Other critical coating characteristics are that the acrylic emulsion coating is heat sealable to itself, to polymers such as polyethylene terephthalate and directly to unprimed paperboard, with or without a clay coating, and can be tack bonded at temperatures of 250° F. or greater. Additionally, so as to avoid food contamination from the coating, the coating is mass stable below 400° F. and have chloroform-soluble extractives not exceeding 0.5 mg/in$^2$ of a food contact surface when exposed to a food simulating solvent, (for example, N-Heptane) at 150° F. for two hours.

2 Claims, 2 Drawing Sheets

HEAT SEALED, OVENABLE FOOD CARTON LIDS

CROSS-REFERENCE TO RELATED APPLICATIONS

This application is a continuation-in-part of U.S. patent application Ser. No. 08/048,794, filed Apr. 16, 1993, entitled "HEAT SEALED, OVENABLE FOOD CARTON", abandon.

BACKGROUND OF THE INVENTION

1. Field of the Invention

The present invention relates to paperboard packages or cartons suitable for distributing, marketing and heating prepared food products.

2. Description of the Prior Art

To meet complex purity and performance specifications, highly specialized packaging systems have been developed for distributing, marketing and heating food for service and consumption. Many of these packaging systems are based upon a structural substrate folded from a pre-printed and die-cut bleached sulphate paperboard as described by U.S. Pat. No. 4/249,978 to T. R. Baker, entitled "Method Of Forming A Heat Resistant Carton", U.S. Pat. No. 3,788,876 to D. R. Baker et al., entitled "Carton Blanks Printed with a Heat Sealable Composition and Method Thereof" and commonly assigned U.S. Pat. No. 4,930,639 to W. R. Rigby, entitled "Ovenable Food Container with Removable Lid".

To protect the paper package or carton from moisture degradation, due to direct contact with a food substance, the internal surfaces of such a carton are coated with a moisture barrier of one or more continuous films of thermoplastic resin. These films are usually applied to the paperboard web, prior to printing and cutting, as a hot, viscous, extruded curtain. Low density polyethylene (LDPE), polypropylene (PP) and polyethylene terephthalate (PET) are three of the more common thermoplastic resins used for this purpose.

Lids for paperboard-based food cartons may take one of several forms including a top flap that is an integral continuation of the same paperboard sheet or "blank" from which the carton vessel is erected, such a top flap being crease hinged to one sidewall of the carton. Another type of lid is an independent paperboard sheet that is adhesively secured or plastic fuse bonded to the carton vessel sidewalls either by direct attachment to the sidewalls or to a small perimeter flange folded from the upper edge of the side-walls.

However, carton lids of the foregoing description require three separate converting operations following the manufacture of the paperboard: 1) extrusion of the thermoplastic barrier coating; 2) printing of the sales graphics; and 3) die cutting of the carton lid blank. Consolidating these operations into a single operation would offer obvious economic advantages. Moreover, relatively high coat weights are required for an extruded moisture barrier (typically from 11 to 26 pounds per 3000 ft.$^2$ ream) since lighter coat weights usually result in an inconsistent polymer layer thickness or a layer with little or no adhesiveness to the paperboard.

Finally an extruded polymer moisture barrier greatly complicates those recycling procedures necessary to recover the carton fiber constituency.

It is therefore, an object of the present invention to provide a food packaging carton lid which utilizes a specialized non-extruded polymer (water-based/acrylic-based emulsion) to serve the same functions as an extruded polymer but which can be applied in lesser amounts and in the same converting operation or process used to print the sales graphics.

Another object of the present invention is to specify the critical characteristics of a water-based polymer emulsion that may be printing press applied to a food contacting paperboard surface.

Finally, another object of the present invention is to provide a printing press applied polymer coating on paperboard cartons for direct food contact applications that quickly heat seals to itself, to PET, or to an unprimed, clay coated surface.

SUMMARY OF THE INVENTION

These and other objects of the invention, to be subsequently described or made apparent, are accomplished by a specialized polymer coat of a water-based acrylic emulsion applied by a printing press or conventional coater to a paperboard carton lid at a rate of one to nine pounds of solids per 3000 ft.$^2$ of surface area. The emulsion should contain no more than 5% of the total polymer units derived from acrylic acid and must neither melt nor lose significant mass at temperatures below 400°F. Furthermore, to assure that the coating does not contaminate the packaged food product, chloroform-soluble extractives from the coated surface should not exceed 0.5 mg/in$^2$ of food contact surface when exposed to a food simulating solvent, (for example, N-Heptane) at 150° F. for two hours.

BRIEF DESCRIPTION OF THE DRAWINGS

The above and other features of the present invention, which will become more apparent as the description proceeds, are best understood by considering the following detailed description in conjunction with the accompanying drawings, wherein like characters represent like parts throughout the several views and in which.

DETAILED DESCRIPTION OF THE INVENTION

A paperboard substrate of the present invention is, typically, constructed from a 0.018 inch thick bleached sulphate sheet. Definitively, the term paperboard describes paper within the thickness range of 0.008 to 0.028 inches. The invention is relevant to the full scope of such a range, as applied to packaging and beyond.

When used for food carton stock, paperboard is usually clay coated on at least one side surface and frequently on both sides. The paperboard trade characterizes a paperboard web or sheet that has been clay coated on one side as C1S and C2S for a sheet coated on both sides. Compositionally, the paperboard coating is a fluidized blend of minerals such as coating clay, calcium carbonate, and/or titanium dioxide with starch or adhesive which is smoothly applied to the traveling web surface. Successive densification and polishing by calendering finishes the mineral coated surface to a high degree of smoothness and a superior graphics print surface.

When C1S paperboard is used for food packaging, the clay coated surface is prepared as the outside surface, i.e., the surface not in contact with the food. Pursuant to the present invention, the other side (the side in contact with the food) is coated with a specialized, water-based acrylic emulsion to be further described in greater detail. The emulsion coating process may be by means of a gravure roll, flexocoater, a rod coater, air knife or screen blade.

A typical acrylic emulsion application rate, for an independent (not connected to the tray or vessel rim flange), CIS paperboard lid that is to be heat sealed to a food carton vessel rim flange is in the range of 3 to 9 pounds per 3000 ft.$^2$ ream. A C2S food carton lid would require only 1 to 4 pounds per 3000 ft.$^2$ ream due to the greater "hold out" of the acrylic emulsion moisture barrier coating inherent in a calendered, clay coated paper surface.

Figure 1:
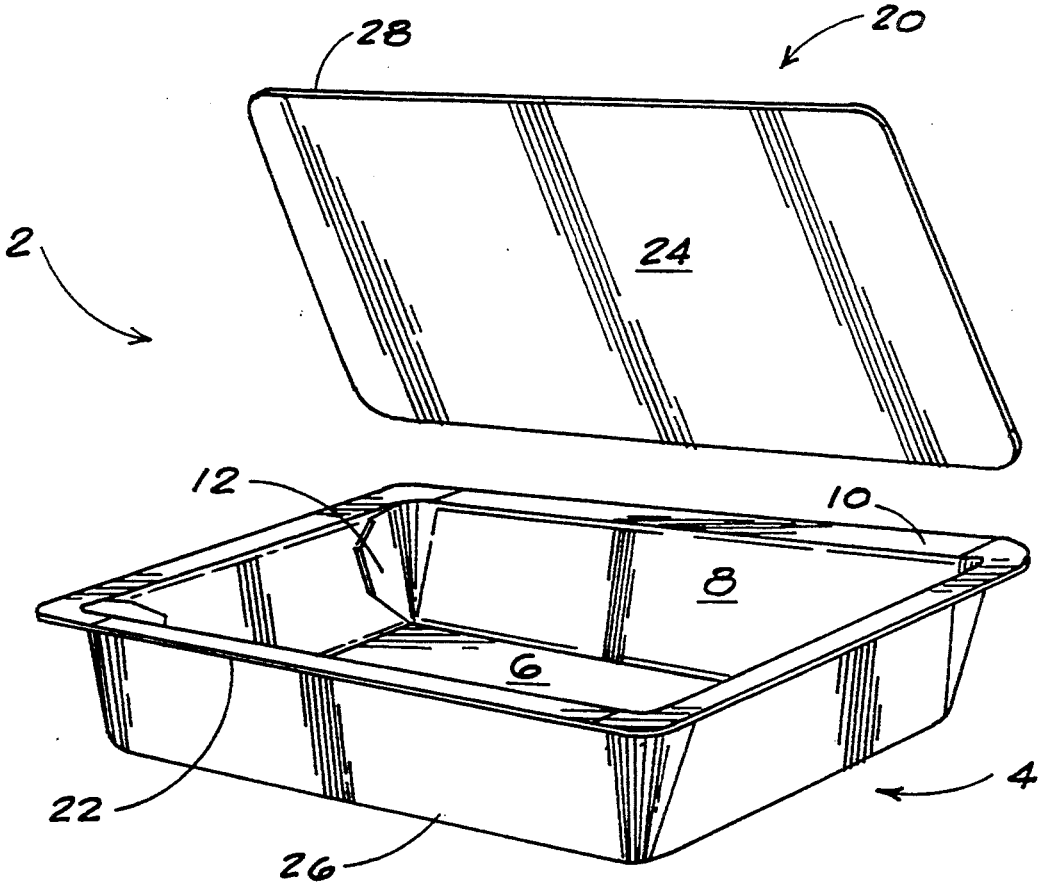
FIG. 1 is a pictorial view of a paperboard food carton having a separate lid closure.

One embodiment of the present invention anticipates a carton 2 construction similar to that of FIG. 1 which broadly comprises a vessel 4 and a closure 20. The vessel components include the bottom panel 6, side walls 8, flange 10, and corner gussets 12. The closure component 20 is separate.

The flat closure or lid 20 in FIG. 1 is cut from a paperboard sheet or web of great length. From a reel material handling system, in the case of a C1S paperboard web, an acrylic water-based emulsion 24 is continuously applied by means of a conventional gravure applicator (not shown) to the non-clay side of the web at a deposition rate of 3 to 9 dry pounds per ream. When a C2S paperboard is used the coating 24 is applied to one of the clay coated surfaces at 1 to 4 dry pounds per ream. Related to FIG. 1, the emulsion coated side 24 of the lid would be the side opposing the internal vessel surface. Also, from a reel handling system, either simultaneous with the emulsion coat application or separately, the clay coated surface ( shown as 26 on vessel 4 and 28 on lid 20, respectively) of the web is printed with sales and informational graphics.

In the normal case of events, printed lid blanks, as depicted in FIG. 1 continuously cut from the sheet or web, are delivered to a food processor as stacks of independent articles. The paperboard vessel 4 is filled with food product prior to lid 20 application and sealing. Lids 20 are typically heat sealed to the tray flanges 10 by utilizing a heated platen, hot air or microwave energy sealing system. Such systems are manufactured by Kliklok Corp. of Atlanta Ga. Raque Food Systems of Louisville, Ky. and Sprinter Systems of Halmstad, Sweden. The paperboard tray or vessel 4 is typically constructed from a basesheet, similar to the lid, and coated (film 22 on vessel 4) on one or both sides with an extruded resin such as PET, PP, or PE.

Obvious alternative permutations of the FIG. 1 carton embodiment would be a pressed formed tray, molded pulp tray, solid plastic tray or a folded tray.

Figure 2:
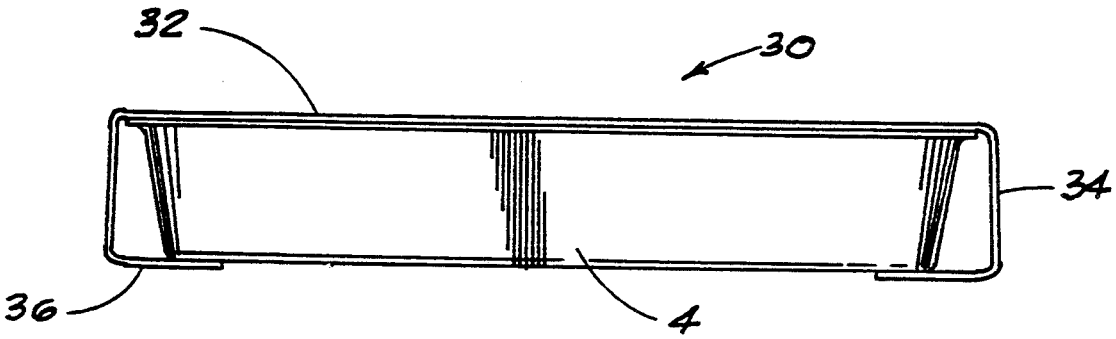
FIG. 2 is a pictorial view of a press-formed paperboard food carton having a separate lid closure.
Figure 3:
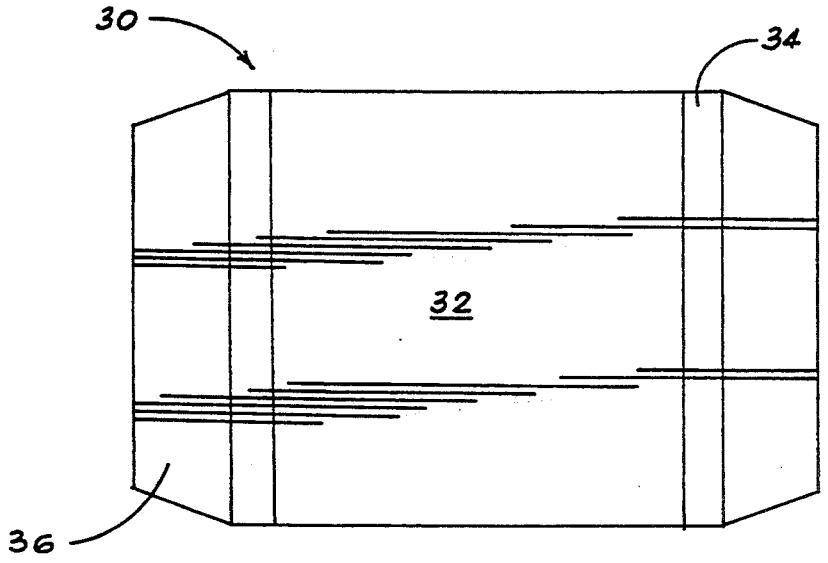
FIG. 3 is a pictorial view of a modified lid for the vessel portion in FIG. 2.

In a second embodiment of the invention, illustrated by FIGS. 2 and 3, the opening of vessel 4 is sealed by an independent cover 30. The container/lid assembly is described in U.S. Pat. No. 5,090,615 to B. D. Hopkins et al., entitled "Container/Lid Assembly" and U.S. Pat. No. 5,234,159 to M. W. Lorence et al., entitled "Container/Lid Assembly". A typical tray style utilized with this lid would be manufactured from pressed paperboard coated on one or both sides with a polymer; however, the alternative tray styles previously mentioned would be applicable. The vessel 4 components include the bottom panel, side walls and flanges similar to that as shown in FIG. 1. The closure 30 components include the top panel 32, side panels 34, and bottom flaps 36. The flat lid blank in FIG. 3 would be manufactured as previously described for FIG. 1; however, the coating may be patterned out of the flap areas, if desired. The lid or closure 30 would be delivered to the food processor as part of stacks of independent articles.

After construction, the pressed paperboard vessel 4 is filled with food product prior to lid 30 application and sealing. Once the lid 30 is heat sealed to the vessel flanges, the flaps 36 are folded and sealed to the tray bottom as represented in FIG. 2.

One representative source of the water-based acrylic emulsion coating, relied upon by the present invention, includes the MW 10 product of Michelman, Inc., 9080 Shell Road, Cincinnati, Ohio. Another such source is the CARBOSET XPD-1103 product of B. F. Goodrich Company, 9911 Brecksville Road, Brecksville, Ohio.

The Michelman MW 10 product comprises an acrylic copolymer resin and high density polyethylene wax. The Goodrich CARBOSET XPD-1103 product is described as an anionic emulsion of an acrylic ester copolymer in water. CARBOSET XPD-1103 is also characterized as a styrene-acrylic copolymer emulsion containing heat activated curing mechanisms stimulated by a 250°–300° F. curing temperature.

Essential properties to both of these water-based acrylic emulsions when used for food contact coatings are: (a) mass stability at temperatures below 400° F., i.e., below 400° F., the coating will not melt, degrade or otherwise lose mass (for instance, by solvent outgassing) and (b) chloroform-soluble extractives levels do not exceed 0.5 mg/in$^2$ of food contact surface when exposed to a solvent, for example, N-Heptane at 150° F. for two hours. These properties are important because they assure that the coating will not contaminate the food in contact with the coating during storage and use of the food carton.

Figure 4:
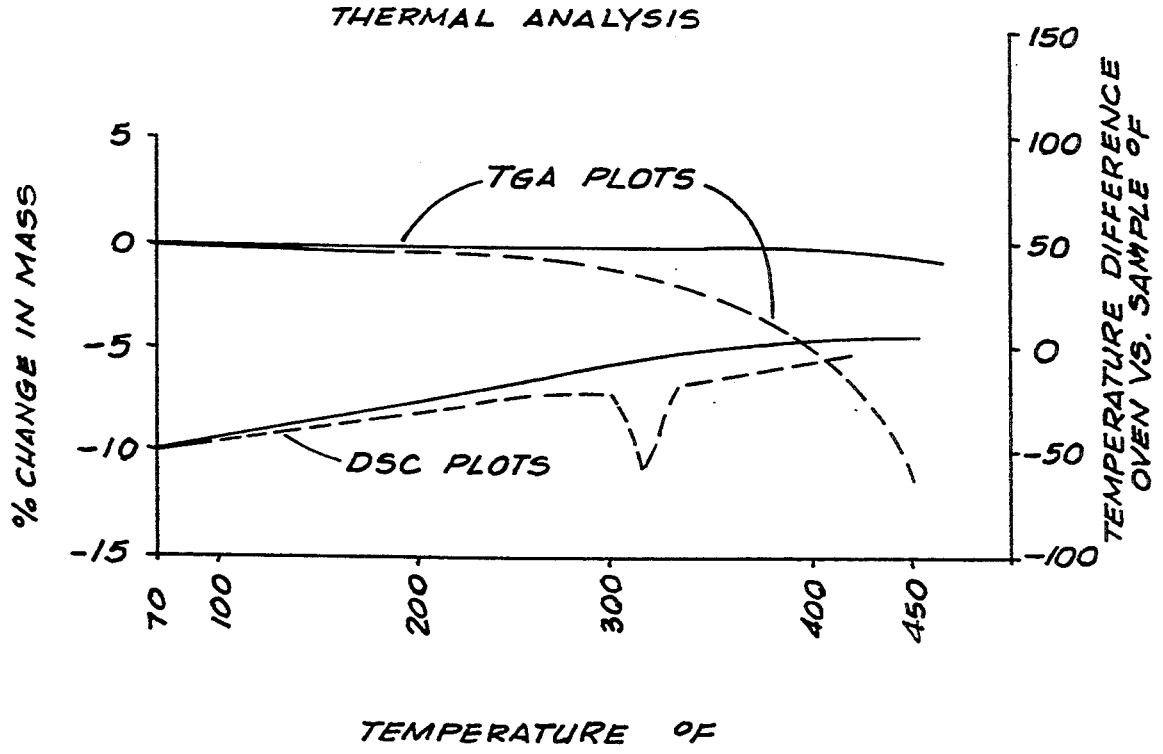
FIG. 4 is a graphical illustration of a thermal analysis of percent changes in mass versus temperature (in °F.) versus temperature differences between the oven and the sample (in °F. ).

Representative mass stability of the Michelman MW-10 product is described in FIG. 4. The Differential Scanning Calorimetry (DSC) plot is a measure of the difference in temperature between the coating sample in an oven plotted against temperature as it is increased from ambient to 400° F+. Any endothermic or exothermic event along the plot would represent a physical transition (i.e. melting). The solid line represents a coating with the necessary thermal properties for ovenable applications. The dotted line is typical of a coating which could not be considered for these applications because it melted at approximately 325° F.

The Thermal Gravimetric Analysis (TGA) plot, also shown in FIG. 4, is a measure of the weight of the coating sample plotted against temperature. Any significant weight loss, as indicated by the dotted TGA plot, indicates product outgassing. The solid TGA plot is representative of an acceptable coating for the use described. The dotted TGA plot is representative of an unacceptable coating due to significant weight loss at temperatures less than 400° F.

As mentioned above, another essential property of the described coated material, which in most cases directly or incidentally contacts the food, is that the materials used do not transfer to the food product during storage or reconstitution. Food substances generally packaged in the cartons described can contain high levels of fats, oils, and sugars. These substances can readily solubilize a coating, given certain conditions, which in turn could be absorbed by the food product.

To assure non-transfer of substances from the lid to the food product, an extraction test on the food contact surface may be employed. Coated paperboard may be tested by use of the extraction cell described in "Official Methods of Analysis of the Association of Official Analytical Chemists," 13th Ed. (1980) sections 21.010–21.015, under "Exposing Flexible Barrier Materials for Extraction." A suitable food simulating solvent for lid applications described would be N-Heptane. The N-Heptane should be a reagent grade, freshly redistilled before use, using only material boiling at 208° F.

The extraction methodology consists of, first, cutting the lid sample to be extracted to a size compatible with the clamping device chosen. Next, the sample to be extracted is placed in the device so that the solvent only contacts the food contact surface. The solvent is then added to the sample holder and placed in an oven for two hours at 150° F.

At the end of the exposure period, the test cell is removed from the oven and the solvent is poured into a clean Pyrex® flask or beaker being sure to rinse the test cell with a small quantity of clean solvent. The food-simulating solvent is evaporated to about 100 millimeters in the container, and transferred to a clean, tared evaporating dish. The flask is washed three times with small portions of the Heptane solvent and the solvent is evaporated to a few millimeters on a hotplate. The last few millimeters should be evaporated in an oven maintained at a temperature of approximately 221° F. The evaporating dish is cooled in a desiccator for 30 minutes.

A chloroform extraction is then performed by adding 50 milliliters of reagent grade chloroform to the residue. The mix is then warmed, then filtered through a Whatman No. 41 filter paper in a Pyrex® funnel and the filtrate is collected in a clean, tared evaporating dish. The chloroform extraction is then repeated by washing the filter paper with a second portion of chloroform. This filtrate is added to the original filtrate and the total is evaporated down to a few millimeters on a low temperature hotplate. The last few millimeters should be evaporated in an oven maintained at approximately 221° F. The evaporating dish is cooled in a desiccator for 30 minutes and weighed to the nearest 0.1 milligram to get the chloroform-soluble extractives residue.

Table 1 below indicates typical values obtained using this procedure for a water-based acrylic copolymer coating having the necessary attributes for the application described herein.

TABLE 1

| Solvent | Time/Temp | Residue (mg/in$^2$) |
|---|---|---|
| N-Heptane | 2 hrs/150° F. | .33 |
| | | .45 |
| | | .27 |

TABLE 1-continued

| Solvent | Time/Temp | Residue (mg/in$^2$) |
|---|---|---|
| | | .28 |
| | | .22 |
| | | .24 |

To be assured that there is no appreciable coating transfer to the food product, the chloroform-soluble extractives should not exceed 0.5 mg/in$^2$.

Another property common to water-based coatings described herein, is that no more than 5% of the total polymer units are derived from one of the following: Acrylic acid; Acrylamide; 1, 3-Butylene glycol dimethacrylate; 1, 4-Butylene glycol dimethacrylate; Diethylene glycol dimethacrylate; Diproplylene glycol dimethacrylate; Divinylbenzene; Ethylene glycol dimethacylate; Itaconic acid; Methacrylic acid; N-Methylolacrylamide; N-Methyl-1, 4-Pentanediol dimethacrylate; Propylene glycol dimethacrylate; Trivinylbenzene; Fumaric acid; Glycidyl methacrylate or N-hexyl methacrylate. These components are necessary to manufacture the coating; however, levels greater than 5% of one or a combination of the above could create a food safety issue.

Other properties of the water-based acrylic emulsion of the present invention are that it is heat sealable to itself, to clay coated board and to other polymers such as polyester and polypropylene.

Representative heat sealibility performance of the Michelman MW-10 product is described in Table 2 below. Samples used for the testing in Table 2 include a press applied coating printed upon a sulphate paperboard that was clay coated on both sides. The cooperative PET samples, to which the present water-based acrylic emulsion is fused, carried a 21 lbs/3000 ft.$^2$ ream hot extrusion coating of PET. Cooperative experimental conditions included a constant 60 psi clamping pressure at 350° F. temperature. The dwell time under the clamp was varied from 0.25 seconds to 2.0 seconds. "MW10"refers to the Michelman MW 10 acrylic emulsion product applied to the 0.018 in. caliper, clay coated paperboard test sample at the rate of 3 lbs/3000 ft.$^2$ ream.

TABLE 2

| Dwell Time (sec) | .25 | .40 | .50 | .75 | 1.00 | 1.25 | 1.50 | 1.75 | 2.00 |
|---|---|---|---|---|---|---|---|---|---|
| PET/PET | — | — | — | 0% | 10% | 50% | 100% | 100% | 100% |
| PET/MW10 | 0% | 10% | 100% | 100% | — | — | — | — | — |
| MW10/MW10 | 0% | 85% | 100% | 100% | — | — | — | — | — |
| PET/Clay | 0% | — | 0% | 0% | 0% | 100% | 100% | — | — |
| MW10/Clay | 0% | — | 0% | 0% | 100% | 100% | 100% | — | — |

Table 2 clearly indicates the heat sealability advantage of this coating in that sealing dwell time can be significantly reduced by having a lid coated with the water-based acrylic of the present invention (0.50 sec) versus a PET lid (1.50 sec.). This reduction in dwell time can significantly increase line speed, sealing efficiency and reduce energy costs.

Those of ordinary skill in the art will recognize the utility value of the present invention for packaging food to be heated, in the original distribution carton, within a traditional convection oven. Alternatively, the food may also be heated in a microwave oven, if desired.

Although the preferred embodiments of the present invention emphasize the unique functional and economic advantages associated with a specialized heat sealable/ovenable coating, it should be recognized that the press applied water-based acrylic emulsion of the present invention is also functional as an effective moisture barrier necessary in the applications described herein.

Once given the above disclosure, many features, modifications or improvements will become apparent to the skilled artisan. Such features, modifications or improvements are, therefore, considered to be a part of this invention, the scope of which to be determined by the following claims.

What is claimed is:

1. A paperboard lid covering a corresponding food distribution vessel fill opening, said paperboard lid having a first side with a calendered coating of particulate minerals which provides an outer surface suitable for the printing of graphics and a second side supporting a continuous coating of a dried, water-based acrylic copolymer emulsion which provides an inner surface suitable for direct food contact, the improvement wherein said dried, water-based acrylic copolymer emulsion further provides vapor barrier properties and for heat sealing said paperboard lid to said food distribution vessel in a covering position over said corresponding fill opening, wherein said dried, water-based acrylic copolymer emulsion is further characterized as being mass stable below 400° F., can be tack bonded at 250° F. or greater, has chloroform-soluble extractives not exceeding 0.5 mg/in$^2$ of food contact surface when exposed to a food simulating solvent at 150° F. for two hours, is applied to said second side with a dry coat weight in the range of 3 to 9 pounds per 3000 ft.$^2$ and wherein said dried copolymer emulsion contains polymer units derived from a monomer selected from the group consisting of Acrylic acid; Acrylamide; 1,3-Butylene glycol dimethacrylate; 1, 4-Butylene glycol dimethacrylate; Diethylene glycol dimethacrylate; Diproplylene glycol dimethacrylate; Divinylbenzene; Ethylene glycol dimethacylate; Itaconic acid; Methacrylic acid; N-Methylolacrylamide; N-Methyl-1,4-pentanediol dimethacrylate; Propylene glycol dimethacrylate; Trivinylbenzene; Fumaric acid; Glycidyl methacrylate and N-hexyl methacrylate in the amount of greater than 0% no more than 5% based on the total polymer units of said dried, copolymer emulsion.

2. The paperboard lid, as in claim 1, wherein said second side is coated with a calendered coat of particulate minerals with said dried, acrylic copolymer emulsion having a dry coat weight of 1 to 4 pounds per 3000 ft$^2$ applied thereover the calendered coat of particulate minerals on said second side.

* * * * *

UNITED STATES PATENT AND TRADEMARK OFFICE

CERTIFICATE OF CORRECTION

PATENT NO. : 5,425,972

DATED : Jun. 20, 1995

INVENTOR(S) : Barry G. Calvert

It is certified that error appears in the above-indentified patent and that said Letters Patent is hereby corrected as shown below:

Column 8, line 17 (Claim 1, line 31), after "0%" insert -- to --:

Signed and Sealed this

Seventeenth Day of October, 1995

Bruce Lehman

*Attest:*

BRUCE LEHMAN

*Attesting Officer*

*Commissioner of Patents and Trademarks*